US011629900B2

(12) United States Patent
Berg et al.

(10) Patent No.: US 11,629,900 B2
(45) Date of Patent: Apr. 18, 2023

(54) DEMAND DEFROST WITH FROST ACCUMULATION FAILSAFE

(71) Applicant: Lennox Industries Inc., Richardson, TX (US)

(72) Inventors: Eric Berg, The Colony, TX (US); Pete Hrejsa, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 17/750,736

(22) Filed: May 23, 2022

(65) Prior Publication Data

US 2022/0282896 A1 Sep. 8, 2022

Related U.S. Application Data

(63) Continuation of application No. 16/881,156, filed on May 22, 2020, now Pat. No. 11,371,762.

(51) Int. Cl.
*F25B 47/02* (2006.01)

(52) U.S. Cl.
CPC .... *F25B 47/025* (2013.01); *F25B 2700/2106* (2013.01); *F25B 2700/2117* (2013.01)

(58) Field of Classification Search
CPC ..... F25B 47/025; F25B 2700/2106; F25B 2700/2117
See application file for complete search history.

(56) References Cited

U.S. PATENT DOCUMENTS 4,481,786 A 11/1984 Bashark
4,750,332 A 6/1988 Jenski et al.
4,852,360 A 8/1989 Harshbarger, Jr. et al.
5,156,010 A 10/1992 Inoue et al.
5,257,506 A 11/1993 DeWolf et al.
5,319,943 A 6/1994 Bahel et al.
5,415,005 A 5/1995 Sterber et al.
5,515,692 A 5/1996 Sterber et al.
5,797,273 A 8/1998 Guo et al.
6,467,282 B1 10/2002 French et al.
(Continued)

FOREIGN PATENT DOCUMENTS

ES 2381186 T3 * 5/2012 ..... A47F 3/04

*Primary Examiner* — Miguel A Diaz

(74) *Attorney, Agent, or Firm* — Shackelford, Bowen, McKinley & Norton, LLP

(57) ABSTRACT

A defrost method for a heat pump system includes running the heat pump system in a heating mode to provide heat to an enclosed space and determining if an outdoor temperature is less than an outdoor threshold temperature. Responsive to a determination that the outdoor temperature is below the outdoor threshold temperature, determining if a calibration state has been previously run. Responsive to a determination that the calibration state has not been previously run, running the heat pump system in the calibration state. Responsive to a determination that the calibration state has been previously run, determining if a temperature difference between a temperature of an evaporator coil of the heat pump system and the outdoor temperature exceeds a temperature threshold value. Responsive to a determination that the temperature difference between the evaporator coil and the outdoor temperature is greater than the temperature threshold value, running the heat pump system in a defrost state.

20 Claims, 6 Drawing Sheets

(56) References Cited

U.S. PATENT DOCUMENTS

| | | | |
|---|---|---|---|
| 9,417,149 | B2 | 8/2016 | Berg et al. |
| 9,625,345 | B2 | 4/2017 | Berg et al. |
| 9,726,412 | B2 | 8/2017 | Berg et al. |
| 9,835,366 | B2 | 12/2017 | Berg et al. |
| 9,964,345 | B2 | 5/2018 | Vie et al. |
| 10,018,394 | B2 | 7/2018 | Berg et al. |
| 10,571,174 | B2 | 2/2020 | Hern et al. |
| 10,746,446 | B2 | 8/2020 | Gokhale et al. |
| 2015/0114080 | A1 | 4/2015 | Berg et al. |
| 2015/0184920 | A1 | 7/2015 | Vie et al. |
| 2015/0184921 | A1 | 7/2015 | Vie et al. |
| 2015/0184922 | A1 | 7/2015 | Vie et al. |
| 2015/0184924 | A1 | 7/2015 | Vie et al. |
| 2016/0178259 | A1 | 6/2016 | Kimura et al. |
| 2016/0299029 | A1 | 10/2016 | Berg et al. |
| 2017/0176072 | A1 | 6/2017 | Gokhale et al. |
| 2017/0184332 | A1 | 6/2017 | Berg et al. |
| 2017/0299243 | A1 | 10/2017 | Berg et al. |
| 2018/0031289 | A1 | 2/2018 | Hern et al. |
| 2018/0045447 | A1 | 2/2018 | Berg et al. |

* cited by examiner

DEMAND DEFROST WITH FROST ACCUMULATION FAILSAFE

CROSS-REFERENCE TO RELATED APPLICATIONS

This application is a continuation of U.S. patent application Ser. No. 16/881,156, filed on May 22, 2020. U.S. patent application Ser. No. 16/881,156 is incorporated herein.

TECHNICAL FIELD

The present invention relates generally to heat pump systems and more particularly, but not by way of limitation, to a method for controlling a defrost cycle of a heat pump system.

BACKGROUND

In a heat pump system running in a heating mode, it is common for frost to form on an exterior coil of the heat pump system. While the heat pump system is operating in the heating mode, the exterior coil can become extremely cool as the heat pump system attempts to transfer heat from exterior ambient air to a refrigerant in the exterior coil. If a temperature of the exterior coil cools to a temperature below a dew point temperature of the exterior ambient air, condensate forms on the exterior coil. If the temperature of the exterior coil drops to a temperature below freezing or the exterior ambient air is below freezing, the condensation will turn into frost on the exterior coil. Formation of frost on the exterior coil is common in most areas where heat pump systems are used.

The formation of frost on the exterior coil reduces the effectiveness of the exterior coil as a heat transfer unit. The exterior coil is designed to transfer heat from the exterior ambient air to the refrigerant inside the exterior coil. To achieve this function, an exterior fan is typically used to draw exterior ambient air across the exterior coil. When frost forms on the exterior coil, an ability of the exterior fan to draw air across the exterior coil is reduced, which reduces the exterior coil's ability to absorb heat from the exterior ambient air.

Methods have been developed to defrost the exterior coil to remove frost that has built up on the exterior coil. One defrost method involves switching the heat pump system into a defrost mode during which the heat pump system operates as an air conditioner to transfer heat from the interior of an enclosed space, such as, for example, a house, to the exterior coil to melt any frost that has formed thereon. The heat pump system then operates as a typical air conditioner to transfer heat from the interior of the house to the exterior coil via a compressor and expansion valve system. In the defrost mode, the refrigerant in the exterior coil becomes warmer such that frost that has formed on the exterior coil melts. Meanwhile, the refrigerant in the interior coil becomes cooler. Interior air that is passed over the cooled interior coil blows out into the heated space. This is known in the industry as "cold blow." Cold blow is typically counteracted with auxiliary heating elements.

When the heat pump system initiates a defrost cycle or process to remove frost from the exterior coil, three events typically occur: 1) the exterior fan is deactivated; 2) a reversing valve shifts from the heating mode to the defrost mode; and 3) the auxiliary heating elements are activated. The exterior fan is deactivated to stop the cooling effect on the frost formed on the exterior coil and to allow the frost to melt. The reversing valve is shifted to reverse the flow of the refrigerant within the heat pump system to provide hot refrigerant to the exterior coil to melt the frost. The auxiliary heating elements are activated to heat the interior air that is blown over the cool interior coil and into the interior of the building in order to provide warm air. The defrost cycle is necessary for the heat pump system to continue operating efficiently; however, minimizing the amount of time the heat pump system runs the defrost cycle is desirable.

SUMMARY

This summary is provided to introduce a selection of concepts that are further described below in the detailed description. This summary is not intended to identify key or essential features of the claimed subject matter, nor is it to be used as an aid in limiting the scope of the claimed subject matter.

An example of a defrost method for a heat pump system includes running the heat pump system in a heating state a first time and determining if a calibration state has been previously run. Responsive to a determination that the calibration state has not been previously run, running the heat pump system in the calibration state. Running the heat pump system in the heating state a second time and determining if a difference in temperature between a clear coil temperature of an evaporator coil of the heat pump system and a current temperature of the evaporator coil is greater than a temperature threshold value. Responsive to a determination that the difference in temperature between the clear coil temperature and the current temperature is less than or equal to the threshold temperature value, running the heat pump system in an initializing defrost state. Responsive to a determination that the difference in temperature between the clear coil temperature and the current temperature is greater than the threshold temperature value, running the heat pump system in a defrost state.

An example of a defrost method for a heat pump system includes running the heat pump system in a heating mode to provide heat to an enclosed space and determining if an outdoor temperature is less than an outdoor threshold temperature. Responsive to a determination that the outdoor temperature is below the outdoor threshold temperature, determining if a calibration state has been previously run. Responsive to a determination that the calibration state has not been previously run, running the heat pump system in the calibration state. Responsive to a determination that the calibration state has been previously run, determining if a temperature difference between a temperature of an evaporator coil of the heat pump system and the outdoor temperature exceeds a temperature threshold value. Responsive to a determination that the temperature difference between the evaporator coil and the outdoor temperature is greater than the temperature threshold value, running the heat pump system in a defrost state.

An example of a heat pump system includes an evaporator coil, a condenser coil coupled to the evaporator coil to permit a fluid to cycle between the evaporator coil and the condenser coil, a compressor coupled between the evaporator coil and the condenser coil, a reversing valve configured to reverse a direction of flow of the fluid through the heat pump system, and a controller for initiating a defrost cycle of the heat pump system. The controller includes a central processing unit and memory configured to: run the heat pump system in a heating mode to provide heat to an enclosed space; determine if an outdoor temperature is less than an outdoor threshold temperature; responsive to a determination that the outdoor temperature is below the outdoor threshold temperature, determine if a calibration state has been previously run; responsive to a determination that the calibration state has not been previously run, run the heat pump system in the calibration state; responsive to a determination that the calibration state has been previously run, determine if a temperature difference between a temperature of an evaporator coil of the heat pump system and the outdoor temperature exceeds a temperature threshold value; and responsive to a determination that the temperature difference between the evaporator coil and the outdoor temperature is greater than the temperature threshold value, run the heat pump system in a defrost state.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Heat pump systems typically include an exterior coil that operates as an evaporator coil and an interior coil that operates as a condenser coil. A person having skill in the art will appreciate that when the heat pump systems operate in the defrost mode, the outdoor coil operates as a condenser coil and the indoor coil operates as evaporator coil. For the purposes of this application, the term "evaporator coil" is used to refer to the exterior coil and the term "condenser coil" is used refer the interior coil irrespective of the operating mode being described unless specifically stated otherwise.

During operation of the heat pump system, if the temperature of the evaporator coil drops below the dew point temperature, water may begin to condense from the ambient air that surrounds the evaporator coil onto the evaporator coil. If the evaporator coil temperature is below freezing, the condensed water freezes to form frost on the evaporator coil. For the heat pump system to operate efficiently, the heat pump system includes a defrost control to periodically initiate a defrost cycle to melt the frost that has accumulated on the evaporator coil.

Prior heat pump systems have incorporated defrost-cycle algorithms based on a temperature of the condenser coil. However, these algorithms can be inefficient, resulting in the defrost cycle being run too late or too soon. Running the defrost cycle too late results in a greater accumulation of frost upon the condenser coil, which negatively impacts the ability of the heat pump system to satisfy a heating demand. Running the defrost cycle too soon also negatively impacts the heat pump system's efficiency to satisfy a heating demand because the heat pump system is forced to rely upon auxiliary heating elements to prevent cold air from being circulated through the enclosed space.

Figure 1:
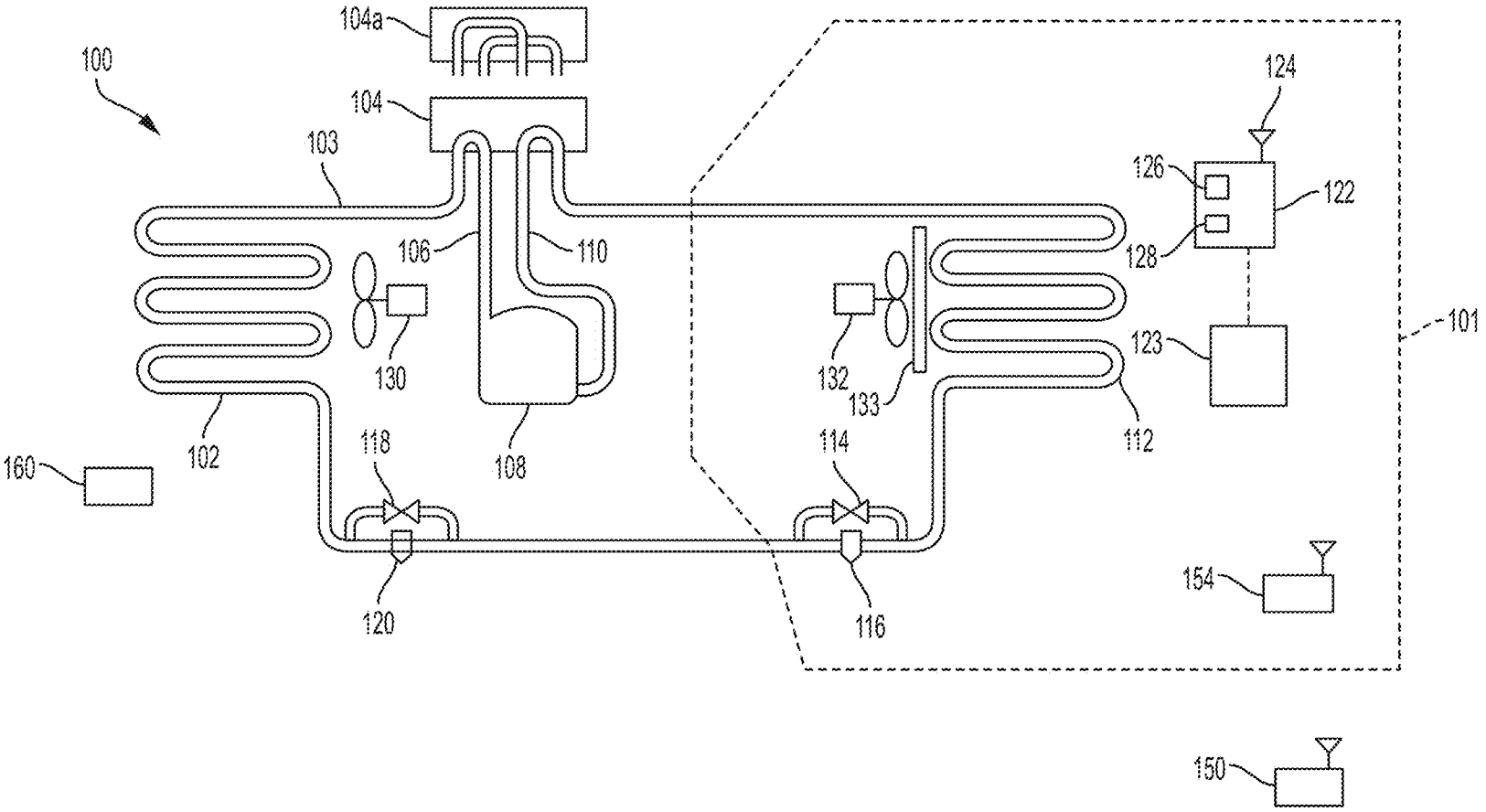
FIG. 1 is a schematic diagram of an illustrative heat pump system, according to embodiments of the disclosure.

Referring now to FIG. 1, a schematic diagram of an illustrative heat pump system 100 is shown. Heat pump system 100 includes an evaporator coil 102, a reversing valve 104, a compressor 108, and a condenser coil 112 that are coupled together to form a circuit through which a refrigerant may flow. Heat pump system 100 also includes a controller 122 that controls the operation of the components within heat pump system 100. Controller 122 comprises a computer that includes components for controlling and monitoring heat pump system 100. For example, controller 122 comprises a central processing unit ("CPU") 126 and memory 128. In a typical embodiment, controller 122 is in communication with a thermostat 123 that allows a user to input a desired temperature for enclosed space 101. Controller 122 may be an integrated controller or a distributed controller that directs operation of heat pump system 100. In a typical embodiment, controller 122 includes an interface to receive, for example, thermostat calls, temperature setpoints, blower control signals, environmental conditions, and operating mode status for heat pump system 100. For example, in a typical embodiment, the environmental conditions may include indoor temperature and relative humidity of enclosed space 101 (shown in FIG. 1).

The refrigerant flows through heat pump system 100 in a continuous heating cycle. Starting from evaporator coil 102, an outlet 103 of evaporator coil 102 is coupled to a suction line 106 of compressor 108 via reversing valve 104 to feed the refrigerant to compressor 108. Compressor 108 compresses the refrigerant. A discharge line 110 feeds compressed refrigerant from compressor 108 through reversing valve 104 to condenser coil 112. In the heat pump configuration, refrigerant traveling from condenser coil 112 flows through a first bypass valve 114, avoiding a first throttling valve 116 that is in the closed position, and is directed to evaporator coil 102. Just before the refrigerant enters evaporator coil 102, the refrigerant passes through a second throttling valve 120, avoiding a second bypass valve 118 that is in a closed position. Second throttling valve 120 reduces a pressure of the refrigerant as it enters evaporator coil 102 and the heating cycle begins again. The behavior of the refrigerant as it flows through heat pump system 100 is discussed in more detail below.

During operation of heat pump system 100, low-pressure, low-temperature refrigerant is circulated through evaporator coil 102. The refrigerant is initially in a liquid/vapor state. In a typical embodiment, the refrigerant is, for example, R-22, R-134a, R-410A, R-744, or any other suitable type of refrigerant as dictated by design requirements. Ambient air from the environment surrounding evaporator coil 102, which is typically warmer than the refrigerant in the evaporator coil, is circulated around evaporator coil 102 by an exterior fan 130. In a typical embodiment, the refrigerant begins to boil after absorbing heat from the ambient air and changes state to a low-pressure, low-temperature, superheated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant leaving evaporator coil 102 is fed into reversing valve 104 that, in the heat pump mode, directs the refrigerant into compressor 108 via the suction line 106. Compressor 108 increases the pressure of the low-pressure, low-temperature, super-heated vapor refrigerant and, by operation of the ideal gas law, also increases the temperature of the low-pressure, low-temperature, super-heated vapor refrigerant to form a high-pressure, high-temperature, superheated vapor refrigerant. The high-pressure, high-temperature, superheated vapor refrigerant leaves compressor 108 via the discharge line 110 and enters reversing valve 104 that, in the heat pump mode, directs the refrigerant to condenser coil 112.

Air from enclosed space 101 is circulated around condenser coil 112 by an interior fan 132. The air from enclosed space 101 is typically cooler than the high-pressure, high-temperature, superheated vapor refrigerant present in condenser coil 112. Thus, heat is transferred from the high-pressure, high-temperature, superheated vapor refrigerant to the air from enclosed space 101. Removal of heat from the high-pressure, high-temperature, superheated vapor refrigerant causes the high-pressure, high-temperature, superheated vapor refrigerant to condense and change from a vapor state to a high-pressure, high-temperature, sub-cooled liquid state. The high-pressure, high-temperature, sub-cooled liquid refrigerant leaves condenser coil 112 and passes through first bypass valve 114. First throttling valve 116 is in the closed position while heat pump system 100 operates as a heat pump. Just before the high-pressure, high-temperature, sub-cooled liquid refrigerant enters evaporator coil 102, the high-pressure, high-temperature, sub-cooled liquid refrigerant passes through second throttling valve 120.

Second throttling valve 120 abruptly reduces the pressure of the high-pressure, high-temperature, sub-cooled liquid refrigerant and regulates an amount of refrigerant that travels to evaporator coil 102. Abrupt reduction of the pressure of the high-pressure, high-temperature, sub-cooled liquid refrigerant causes sudden, rapid, evaporation of a portion of the high-pressure, high-temperature, sub-cooled liquid refrigerant, commonly known as "flash evaporation." The flash evaporation lowers the temperature of the resulting liquid/vapor refrigerant mixture to a temperature lower than a temperature of the ambient air. The liquid/vapor refrigerant mixture leaves second throttling valve 120 and returns to evaporator coil 102, and the cycle begins again. This cycle continues as needed or until heat pump system 100 determines that a defrost cycle needs to be run to remove frost that has built up on evaporator coil 102.

As shown in FIG. 1, heat pump system 100 is operating as a heat pump to provide heat to enclosed space 101. However, in order to defrost evaporator coil 102, heat pump system 100 must be configured to operate in the defrost mode. To initiate the defrost mode, controller 122 reverses the flow of the refrigerant through heat pump system 100 to cause evaporator coil 102 to act as a condenser coil and to cause condenser coil 112 to act as an evaporator coil. Repurposing the evaporator coil 102 to act as a condenser coil causes the temperature of evaporator coil 102 to increase, thereby melting any frost that has accumulated on evaporator coil 102.

To operate heat pump system 100 in the defrost mode, controller 122: 1) switches reversing valve 104 to the valve configuration illustrated as reversing valve 104*a* to reverse the flow direction of the refrigerant through heat pump system 100; 2) closes first bypass valve 114 and opens first throttling valve 116; and 3) closes second throttling valve 120 and opens second bypass valve 118. So configured, heat pump system 100 provides warm refrigerant to evaporator coil 102 to melt frost from evaporator coil 102. However, with condenser coil 112 operating as an evaporator coil, the air blown over condenser coil 112 by interior fan 132 is cooled by condenser coil 112, which now has cold refrigerant passing therethrough. To counter this cooling effect, a heating element 133 is activated to warm the air inside enclosed space 101. In a typical embodiment, heating element 133 is a resistive heating element. In other embodiments, heating element 133 may comprise other devices that permit air passing around heating element 133 to be warmed.

Controller 122 is configured to communicate with the components of heat pump system 100 to monitor and control the components of heat pump system 100. Communication between controller 122 and the components of heat pump system 100 may be via a wired or a wireless connection. In a typical embodiment, controller 122 is configured to control operation of one or more of reversing valve 104, compressor 108, first bypass valve 114, first throttling valve 116, second bypass valve 118, second throttling valve 120, exterior fan 130, interior fan 132, and heating element 133. Heating element 133 is used during the defrost cycle to heat air from enclosed space 101 that is blown over condenser coil 112 by interior fan 132. Controller 122 controls whether reversing valve 104 is in the heat pump mode or the defrost mode. Controller 122 also controls whether or not compressor 108 is operating. In some embodiments, compressor 108 may be a variable or multispeed compressor. In such embodiments, controller 122 controls the speed at which compressor 108 operates. In some aspects, controller 122 controls whether first bypass valve 114, first throttling valve 116, second bypass valve 118, and second throttling valve 120 are in the open or closed position. In some aspects, first bypass valve 114, first throttling valve 116, second bypass valve 118, and second throttling valve 120 may be controlled by changes in system pressures and/temperatures, independent of controller 122. Controller 122 also controls whether exterior fan 130 and interior fan 132 are operating. In some embodiments, one or both of exterior fan 130 and interior fan 132 may be variable or multispeed fans. In such embodiments, controller 122 controls the speed at which exterior fan 130 and interior fan 132 operate.

Controller 122 can communicate with an external data source 150 via an antenna 124. In some embodiments, controller 122 may use antenna 124 to communicate with a router 154. Router 154 may be, for example, an internet access point that is connected to the Internet. External data source 150 provides data regarding local environmental conditions to controller 122 and may be, for example, an internet weather-data service. In a typical embodiment, the data from external data source 150 may include: temperature, humidity, dew point temperature, forecast information, and the like. Forecast information can include predictions about future temperature, humidity, dew point temperature, and the like. In some embodiments, controller 122 can monitor the ambient conditions (e.g., temperature and humidity) near evaporator coil 102 via a sensor 160 positioned proximal to evaporator coil 102. The temperature of evaporator coil 102 may be measured with a sensor 162 associated with evaporator coil 102. In some embodiments, sensor 160 and sensor 162 may include multiple sensors to monitor multiple aspects of the environmental conditions of evaporator coil 102.

Figure 2:
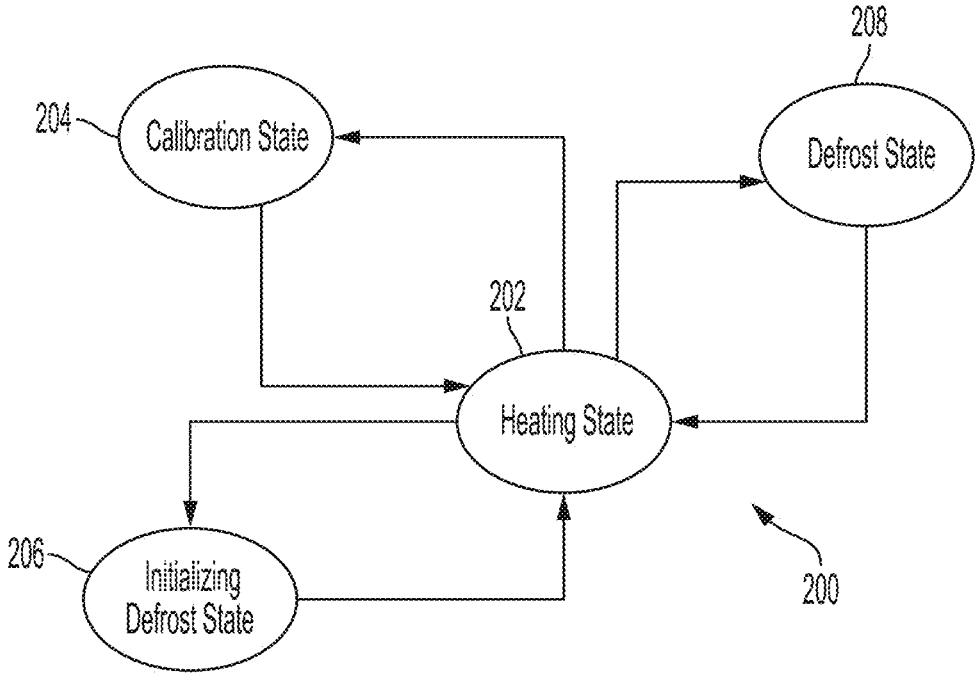
FIG. 2 is a flow diagram illustrating an exemplary method for providing demand-defrost for a heat pump system, according to embodiments of the disclosure.

Referring now to FIG. 2, a method 200 for providing defrost on demand for heat pump system 100 is illustrated. For illustrative purposes, method 200 will be discussed relative to FIG. 1. Method 200 begins with heat pump system 100 operating in a heating state 202. In heating state 202, heat pump system 100 operates in the heating mode to provide heated air to enclosed space 101 to satisfy a heating demand thereof. After a predetermined period of time (e.g., thirty minutes), method 200 proceeds to a calibration state 204. The predetermined period of time is selected to be a limited amount of time to allow formation of some frost upon evaporator coil 102, but not so much frost as to significantly affect the operation of heat pump system 100. In a typical embodiment, the predetermined period of time may be thirty minutes. In calibration state 204, heat pump system 100 is operated in the defrost mode to ensure that any frost that has formed upon evaporator coil 102 is removed. In calibration state 204, controller 122 determines a difference between the temperature of evaporator coil 102 and the ambient temperature to set a basepoint from which controller 122 can determine when to perform future defrost operations. In some embodiments, controller 122 sets a default period of time of ninety minutes. After calibration state 204, method 200 returns to heating state 202 and heat pump system 100 provides additional heating to enclosed space 101.

After the default period of time set by controller 122 in calibration state 204 (e.g., ninety minutes), method 200 proceeds to an initializing defrost state 206. In initializing defrost state 206, heat pump system 100 is again operated in the defrost mode to remove any new frost that has formed upon evaporator coil 102. In initializing defrost state 206, controller 122 also increases the value of a defrost failsafe time by adding a time increment thereto (e.g., controller 122 adds fifteen minutes to the defrost failsafe time). The defrost failsafe time is the longest time heat pump system 100 is permitted to operate in the heating mode before a defrost process must be run. The defrost failsafe time is intended to prevent too much frost from accumulating upon evaporator coil 102 by limiting an amount of time that heat pump system 100 is allowed to operate in the heating mode before a defrost process is run. The defrost failsafe time begins as a pre-set value that is selected based upon the specifications of a particular heat pump system. Method 200 then returns from initializing defrost state 206 to heating state 202 to provide additional heating to enclosed space 101. After operating in the heating state 202, method 200 then proceeds to defrost state 208.

In defrost state 208, controller 122 measures the amount of time the defrost process runs, and uses that value to determine how long to wait until running the next defrost process. Method 200 then returns to heating state 202. Heat pump system 100 will then continue to run in heating state 202 for the period of time determined during defrost state 208, after which time heat pump system 100 once again returns to defrost state 208. From this point on, heat pump system 100 cycles between heating state 202 and defrost state 208 as dictated by method 200 to manage the amount of frost that forms upon evaporator coil 102. Each of states 202, 204, 206, and 208 are discussed in more detail below with respect to FIGS. 3-6, respectively.

Figure 3:
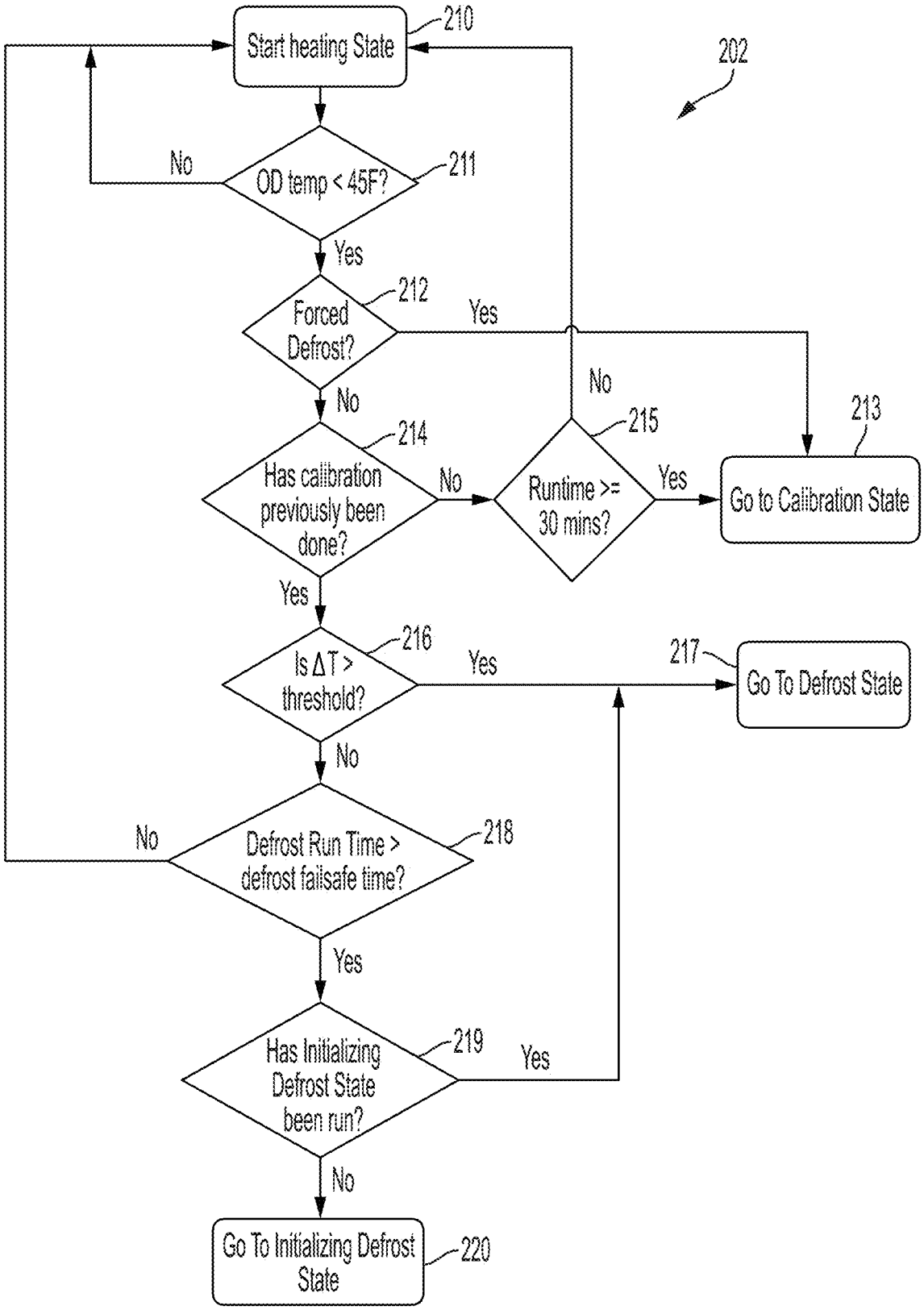
FIG. 3 is a flow diagram illustrating an exemplary heating state for a heat pump system, according to embodiments of the disclosure.

Referring now to FIG. 3, heating state 202 is illustrated in more detail. For illustrative purposes, FIG. 3 will be discussed relative to FIGS. 1 and 2. Heating state 202 begins at step 210. Method 200 then proceeds to step 211. In step 211, controller 122 determines if the outdoor temperature (i.e., the ambient temperature surrounding evaporator coil 102) is below an outdoor threshold temperature. The outdoor threshold temperature is preset and is a temperature below which the formation of frost is likely (e.g., 45° F.). Controller 122 may obtain the outdoor temperature from, for example, sensor 160 or external data source 150. At temperatures below 45° F., the formation of frost upon evaporator coil 102 is likely. At temperatures above 45° F., the formation of frost upon evaporator coil 102 is less likely. In other embodiments, controller 122 may monitor for temperatures other than 45° F. (e.g., the outdoor threshold temperature may be any temperature between about 32° F.-50° F.). If it is determined at step 211 that the outdoor temperature is not less than the outdoor threshold temperature, method 200 returns to step 210. However, if it is determined at step 211 that the outdoor temperature is below the outdoor threshold temperature, method 200 proceeds to step 212.

In step 212, controller 122 determines if a request for a forced defrost has been made. A forced defrost is the result of a user-initiated command or request. For example, controller 122 may include a button (or series of buttons) that may be pressed to manually force the defrost process to begin. If, in step 212, controller 122 determines that a user-initiated request for a forced defrost has been made, method 200 proceeds to step 213. In step 213, method 200 exits heating state 202 and enters calibration state 204. Calibration state 204 is discussed in more detail with respect to FIG. 4.

If, in step 212, controller 122 determines that a user-initiated request for a forced defrost did not occur, method 200 proceeds to step 214. In step 214, controller 122 determines if calibration state 204 has been previously completed. If controller 122 determines that calibration state 204 has not been previously completed, method 200 proceeds to step 215. In step 215, controller 122 determines if heat pump system 100 has been operating in the heating mode for more than a defrost threshold time. If controller 122 determines that heat pump system 100 has been operating in the heating mode for more than the defrost threshold time, method 200 proceeds to step 213. If controller 122 determines that heat pump system 100 has not been operating in the heating mode for more than the defrost threshold time, method 200 returns to step 210. In some embodiments, the defrost threshold time is thirty minutes. In other embodiments, the defrost threshold time may be another value as dictated by design requirements. The purpose of the defrost threshold time is to prevent running the defrost process so early that frost could not have formed.

If, in step 214, controller 122 determines that calibration state 204 has been previously completed, method 200 proceeds to step 216. In step 216, controller 122 determines if the difference in temperature between a clear coil temperature of evaporator coil 102 (i.e., the temperature of evaporator coil 102 when no frost is present) and the current temperature of evaporator coil 102 ($\Delta T = T_{clear_coil} - T_{current_coil}$) is greater than a temperature threshold value. The temperature threshold value is a preset value. In some embodiments, the threshold value is between 0.1° F. and 20° F. $T_{clear_coil}$ is the temperature of evaporator coil 102 when no frost is present on evaporator coil 102. $T_{clear_coil}$ is measured by sensor 162 and may be stored in memory 128 of controller 122. $T_{current_coil}$ is also measured by sensor 162, but is measured during heating state 202. If controller 122 determines that ΔT is greater than the threshold value, method 200 proceeds to step 217. In step 217, method 200 exits heating state 202 and proceeds to defrost state 208. If controller 122 determines that ΔT is less than the threshold value, method 200 proceeds to step 218.

In step 218, controller 122 determines if heat pump system 100 has been running in heating state 202 for longer than the defrost failsafe time. The defrost failsafe time is the longest time heat pump system 100 is permitted to operate before a defrost process must be run. In other words, if a defrost process has not been run after an amount of time that is equal to the defrost failsafe time has elapsed, the defrost process is initiated. The defrost failsafe time is meant to prevent evaporator coil 102 from accumulating large amounts of frost. If heat pump system 100 has been running for a period of time that is less than the defrost failsafe time, method 200 returns to step 210. If heat pump system 100 has been running for a period of time that is greater than or equal to the defrost failsafe time, method 200 proceeds to step 219. In step 219, controller 122 determines if heat pump system 100 has already completed initializing defrost state 206. If controller 122 determines that heat pump system has previously completed initializing defrost state 206, method 200 returns to step 217. If controller 122 determines that heat pump system has not completed initializing defrost state 206, method 200 proceeds to step 220. In step 220, method 200 exits heating state 202 and proceeds to initializing defrost state 206.

Figure 4:
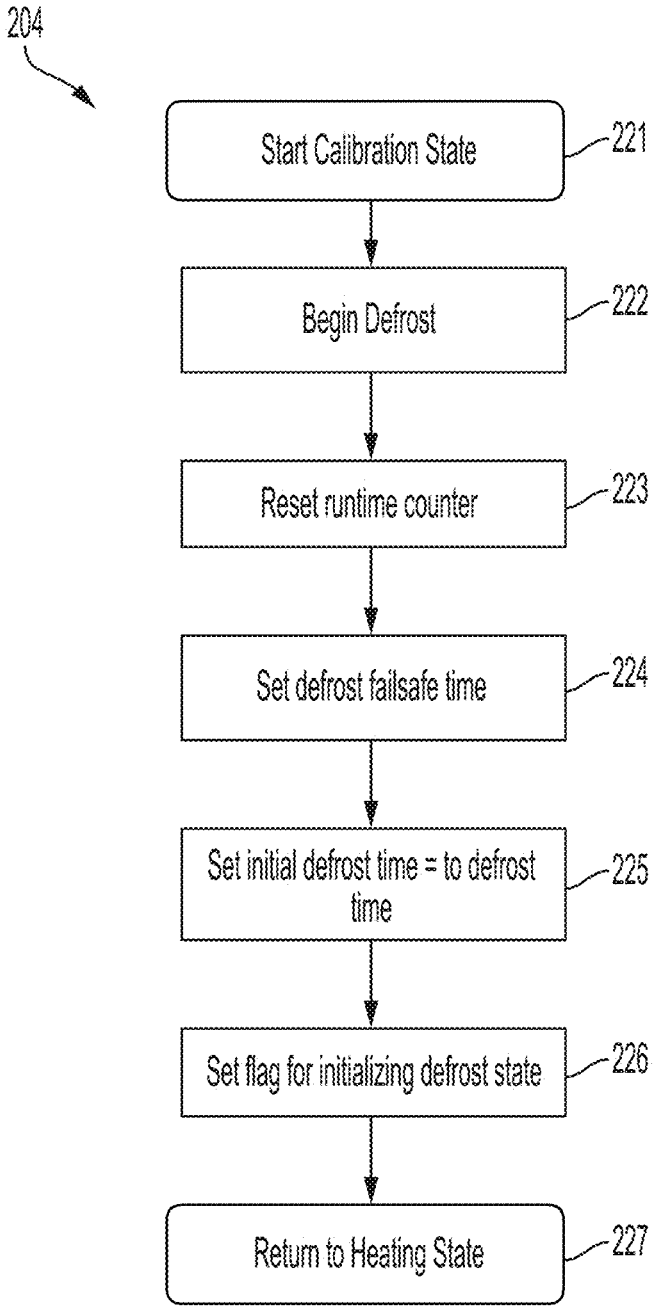
FIG. 4 is a flow diagram illustrating an exemplary calibration state for a heat pump system, according to embodiments of the disclosure.

Referring now to FIG. 4, calibration state 204 is illustrated in more detail. For illustrative purposes, FIG. 4 will be discussed relative to FIGS. 1-3. Calibration state 204 begins at step 221. In step 222, the defrost process is begun by operating heat pump system 100 in the defrost mode to remove frost from evaporator coil 102. Method 200 then proceeds to step 223. In step 223, controller 122 resets a runtime counter to measure the amount of time the defrost process of step 222 takes. The defrost process terminates when the temperature of evaporator coil 102 reaches a threshold temperature as measured by sensor 162. The threshold temperature is a predetermined value and may be, for example, 50-100° F. The threshold temperature is selected to be a temperature at which no frost remains on evaporator coil 102. Method 200 then proceeds to step 224. In step 224, controller 122 sets a value for the defrost failsafe time referenced above with respect to heating state 202. In some embodiments, the defrost failsafe time is set for 120 minutes. In other embodiments, the defrost failsafe time may be set to a different length of time as desired. Method 200 then proceeds to step 225. In step 225, controller 122 sets a value of a defrost time to be equal to an initial defrost time as measured in step 223. In other aspects, the defrost time is empirically determined or a modifier is used that increases or decreases the initial defrost time. The initial defrost time is the amount of time the defrost process runs in step 222 and it is the amount of time required for frost to melt from evaporator coil 102. Method 200 then proceeds to step 226. In step 226, controller 122 sets a value of an initializing defrost flag to false (e.g., sets the value to 0) to indicate in step 219 that method 200 should proceed to initializing defrost state 206. Method 200 then proceeds to step 227. In step 227, method 200 exits calibration state 204 and returns to heating state 202.

Figure 5:
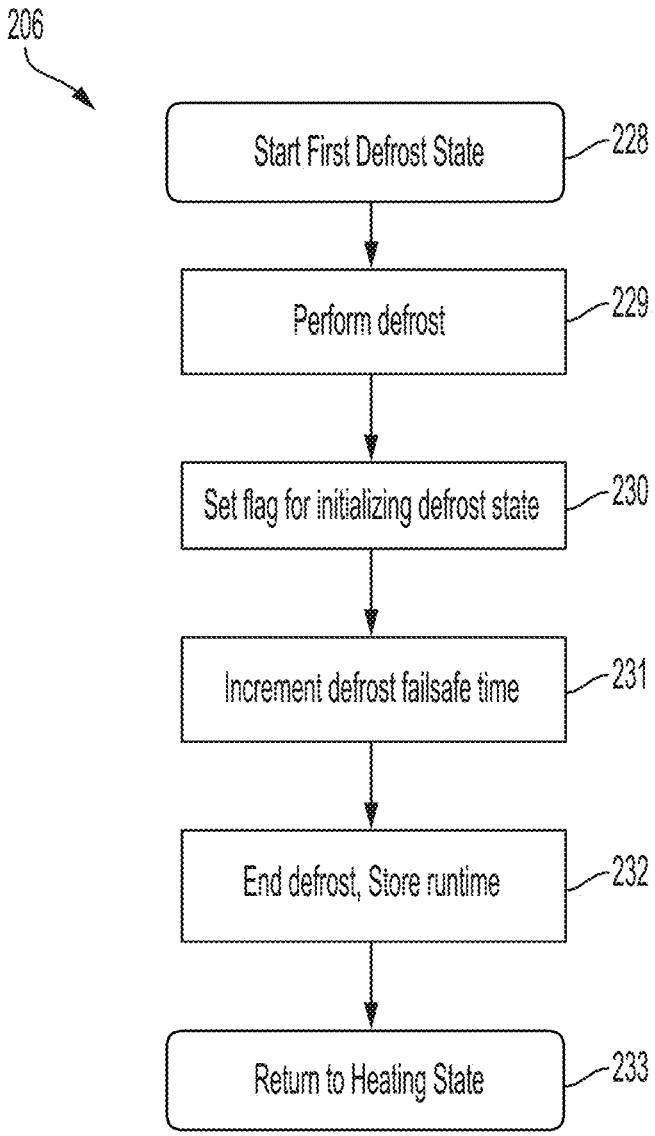
FIG. 5 is a flow diagram illustrating an exemplary initializing defrost state for a heat pump system, according to embodiments of the disclosure.

Referring now to FIG. 5, initializing defrost state 206 is illustrated in more detail. Initializing defrost state 206 begins at step 228. For illustrative purposes, FIG. 5 will be discussed relative to FIGS. 1-4. In step 229, controller 122 initiates the defrost process. Method 200 then proceeds to step 230. In step 230, controller 122 sets the value of the initializing defrost flag to true (e.g., sets the value to 1) to indicate in step 219 that method 200 should proceed to defrost state 208. Method 200 then proceeds to step 231. In step 231, controller 122 increases the value of the defrost failsafe time by adding a time increment thereto. The amount of time added to the defrost failsafe time may be varied as desired and is determined based upon system conditions. In various embodiments, the time increment may a value between 5 and 60 minutes. Method 200 then proceeds to step 232. In step 232, the defrost process ends and a runtime for the completed defrost process is stored in memory. Controller 122 ends the defrost process in response to data received from sensor 162. For example, controller 122 monitors the temperature of evaporator coil 102 via sensor 162. Once the temperature measured by sensor 162 exceeds a threshold value (e.g., a temperature of 50-100° F.), controller 122 ends the defrost process. Method 200 then proceeds to step 233. In step 233, method 200 exits initializing defrost state 206 and returns to heating state 202.

Figure 6:
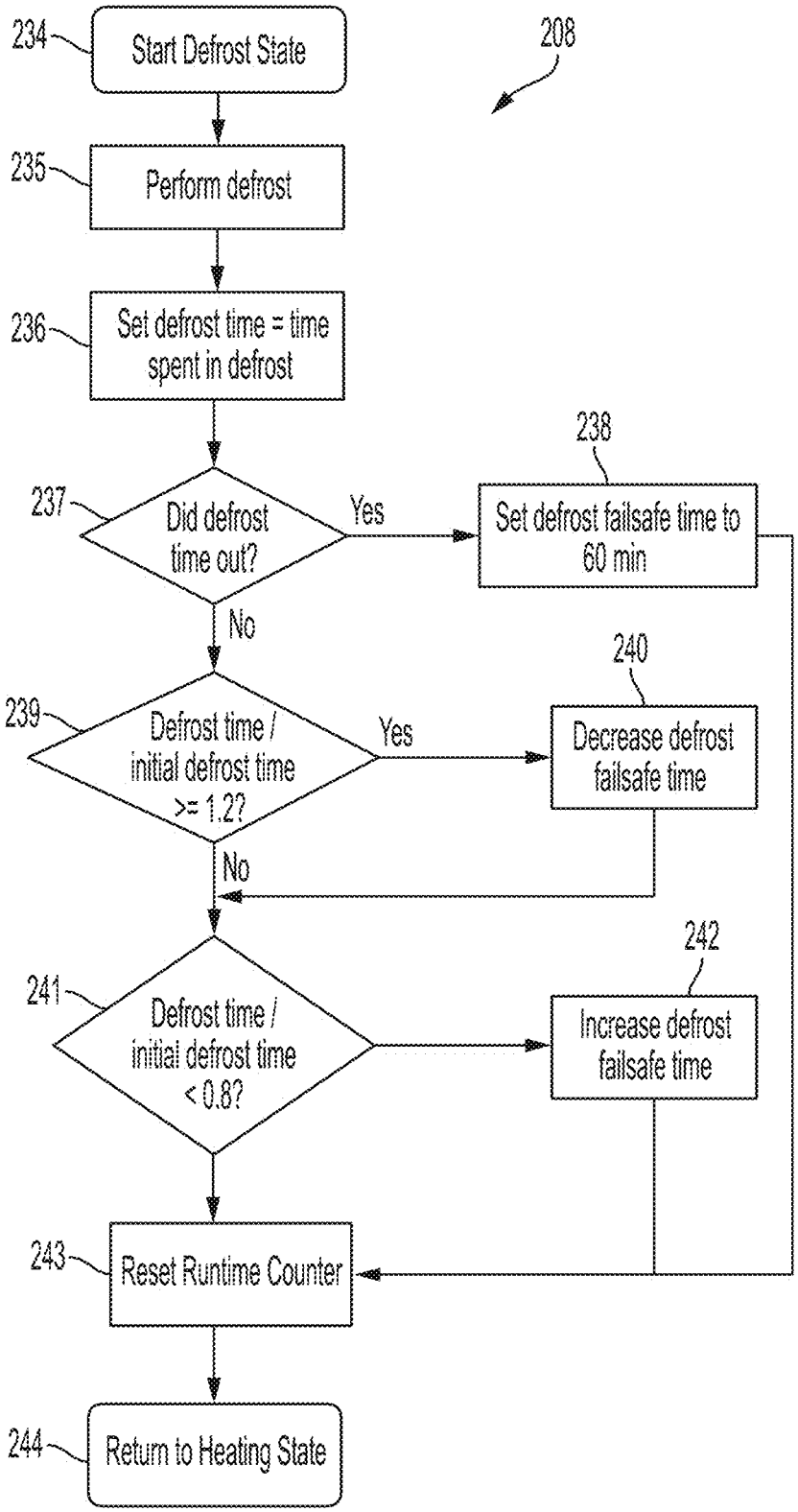
FIG. 6 is a flow diagram illustrating an exemplary defrost state for a heat pump system, according to embodiments of the disclosure.

Referring now to FIG. 6, defrost state 208 is illustrated in more detail. For illustrative purposes, FIG. 6 will be discussed relative to FIGS. 1-5. Defrost state 208 begins at step 234. In step 235, controller 122 initiates the defrost process. Method 200 then proceeds to step 236. In step 236, controller 122 sets a timer to measure the run time for the defrost process of step 235. Method 200 then proceeds to step 237. In step 237, controller 122 determines if the defrost process of step 235 timed out. The defrost process times out when the defrost process has been running longer than a maximum defrost time. The maximum defrost time is the maximum amount of time heat pump system 100 is allowed to run in the defrost mode. The amount of time heat pump system 100 operates in the defrost mode is limited because running heat pump system 100 in the defrost mode comparatively inefficient for providing heat to enclosed space 100 to running heat pump system 100 in the heating mode. In some embodiments, the maximum defrost time is fourteen minutes. In other embodiments, the maximum defrost time can be greater than or less than fourteen minutes. The length of the maximum defrost time varies depending on environmental conditions (e.g., ambient temperature, ambient humidity, etc.) and depending on specifications of heat pump system 100 (e.g., heating and cool capacity, etc.). If controller 122 determines that the defrost process of step 235 did time out, method 200 proceeds to step 238. In step 238, the defrost failsafe time is reduced from the value set in step 224 of calibration state 204. The defrost failsafe time in this case is reduced because the defrost process timing out is an indication that too much frost was allowed to accumulate upon evaporator coil 102 and evaporator coil 102 never reached a temperature to melt all of the frost formed thereon. To prevent too much frost from accumulating upon evaporator coil 102, the defrost process in this situation should be run more frequently. Decreasing the defrost failsafe time causes the defrost process to be run more frequently. In some embodiments, the defrost failsafe time is reduced from ninety minutes to sixty minutes. In other embodiments, the defrost failsafe time may be reduced to another value. Method 200 then proceeds to step 243

If, in step 237, controller 122 determines that the defrost process of step 235 did not time out, method 200 proceeds to step 239. In step 239, controller 122 determines if a ratio of the defrost time measured in step 236 to the initial defrost time set in step 225 is greater than or equal to a first threshold value. The determination of step 239 is used to determine if the defrost failsafe time is too long (i.e., the amount of time needed to defrost evaporator coil 102 is more than the ideal defrost time (i.e., the initial defrost time)). In some embodiments, the first threshold value in step 239 is 1.2. In other embodiments, the first threshold value in step 239 is any value above 1. If, in step 239, controller 122 determines that the ratio is greater than the first threshold value, method 200 proceeds to step 240. In step 240, controller 122 decreases the value of the defrost failsafe time. In some embodiments, the defrost failsafe time is reduced by fifteen minutes. The defrost failsafe time that is being modified in this instance is the most recent defrost failsafe time. For example, if the first defrost resulted in the defrost failsafe time decreasing from 90 to 75 minutes, then the next time the unit went through a defrost, the defrost failsafe time would be 75 minutes. If after that defrost, the defrost failsafe time needed to be decreased again, it would change from 75 to 60 minutes. In other embodiments, the defrost failsafe time may be reduced by more than fifteen minutes or less than fifteen minutes. In some embodiments, the minimum amount of time for the defrost failsafe time is sixty minutes. Method 200 then proceeds to step 241.

If, in step 239, controller 122 determines that the ratio of the defrost time measured in step 236 to the initial defrost time set in step 225 is less than the first threshold value of step 239, method 200 proceeds to step 241. In step 241, controller 122 determines if the ratio of the defrost time measured in step 236 to the initial defrost time set in step 225 is less than a second threshold value. In some embodiments, the second threshold value in step 241 is 0.8. In other embodiments, the second threshold value in step 241 is any value below 1. In any case, the value of the second threshold is always lower than the value of the first threshold. If, in step 241, controller 122 determines that the ratio is less than the second threshold value, method 200 proceeds to step 242. In step 242, controller 122 increases the value of the defrost failsafe time. The defrost failsafe time that is being modified in this instance is the most recent defrost failsafe time. For example, if the first defrost resulted in the defrost failsafe time increasing from 90 to 105 minutes, then the next time the unit went through a defrost, the defrost failsafe time would be 105 minutes. If after that defrost, the defrost failsafe time needed to be increased again, it would change from 105 to 120 minutes. In some embodiments, the defrost failsafe time is increased by fifteen minutes. In other embodiments, the defrost failsafe time may be increased by more than fifteen minutes or less than fifteen minutes. In some embodiments, the maximum defrost failsafe time is 360 minutes. The defrost failsafe time is increased in step 242 because the ratio in step 241 indicates that the defrost process in step 235 took less time than the ideal defrost time to defrost evaporator coil 102, which in turn indicates that the time between defrost processes may be increased. Method 200 then proceeds to step 243.

If controller 122 determines from steps 239 and 241 that the ratio is between the values of the first and second thresholds, method 200 proceeds to step 243 without performing either of steps 240 or 242. In step 243, controller 122 resets the runtime counter to prepare the timer for the next defrost period. Method 200 then proceeds to step 244. In step 244, method 200 exits defrost state 208 and returns to heating state 202.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within [a percentage] of" what is specified, where the percentage includes 0.1, 1, 5, and 10 percent.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A defrost method for a heat pump system, the defrost method comprising, by a controller comprising a central processing unit and memory:

running the heat pump system in a heating state a first time and determining if a calibration state has been previously run;

responsive to a determination that the calibration state has not been previously run, running the heat pump system in the calibration state;

running the heat pump system in the heating state a second time and determining if a difference in temperature between a clear coil temperature of an evaporator coil of the heat pump system and a current temperature of the evaporator coil is greater than a temperature threshold value;

responsive to a determination that the difference in temperature between the clear coil temperature and the current temperature is less than or equal to the threshold temperature value, running the heat pump system in an initializing defrost state;

responsive to a determination that the difference in temperature between the clear coil temperature and the current temperature is greater than the threshold temperature value, running the heat pump system in a defrost state;

monitoring an amount of time that the heat pump system runs in a defrost mode;

determining a ratio of the amount of time to an initial defrost time; and responsive to a determination that the ratio is between a first threshold value and a second threshold value, adding no time to a defrost failsafe time.

2. The defrost method of claim 1, wherein the heating state comprises running the heat pump system as a heat pump to provide heat to an enclosed space.

3. The defrost method of claim 1, wherein the initializing defrost state comprises:

running the heat pump system in the defrost mode to transfer heat from an enclosed space to the evaporator coil located outside of the enclosed space to melt frost that has formed on the evaporator coil; and adding time to the defrost failsafe time.

4. The defrost method of claim 1, wherein the defrost state comprises:

running the heat pump system in the defrost mode to transfer heat from an enclosed space to the evaporator coil located outside of the enclosed space to melt frost that has formed on the evaporator coil.

5. The defrost method of claim 1, wherein the calibration state comprises:

running the heat pump system in the defrost mode to transfer heat from an enclosed space to the evaporator coil located outside of the enclosed space to melt frost that has formed on the evaporator coil; and setting a value for the defrost failsafe time.

6. The defrost method of claim 5, wherein the calibration state comprises setting a value of a defrost flag to true.

7. The defrost method of claim 1, comprising:

determining if the amount of time is greater than a maximum defrost time; and responsive to a determination that the amount of time is greater than the maximum defrost time, shortening the defrost failsafe time to run the defrost state more frequently.

8. The defrost method of claim 7, wherein, responsive to a determination that the amount of time is less than the maximum defrost time, lengthening the defrost failsafe time to run the defrost state less frequently.

9. The defrost method of claim 1, comprising:

responsive to a determination that that the ratio is greater than the first threshold value, decreasing the defrost failsafe time to run the defrost state more frequently.

10. The defrost method of claim 9, wherein, responsive to a determination that the ratio is less than the second threshold value, increasing the defrost failsafe time to run the defrost state less frequently.

11. A defrost method for a heat pump system, the defrost method comprising, by a controller comprising a central processing unit and memory:

running the heat pump system in a heating state a first time and determining if a calibration state has been previously run;

responsive to a determination that the calibration state has not been previously run, running the heat pump system in the calibration state;

running the heat pump system in the heating state a second time and determining if a difference in temperature between a clear coil temperature of an evaporator coil of the heat pump system and a current temperature of the evaporator coil is greater than a temperature threshold value;

responsive to a determination that the difference in temperature between the clear coil temperature and the current temperature is less than or equal to the threshold temperature value, running the heat pump system in an initializing defrost state;

responsive to a determination that the difference in temperature between the clear coil temperature and the current temperature is greater than the threshold temperature value, running the heat pump system in a defrost state;

monitoring an amount of time that the heat pump system runs in a defrost mode;

determining a ratio of the amount of time to an initial defrost time; and responsive to a determination that the ratio is less than a second threshold value, increasing a defrost failsafe time to run the defrost state less frequently.

12. The defrost method of claim 11, wherein the heating state comprises running the heat pump system as a heat pump to provide heat to an enclosed space.

13. The defrost method of claim 11, wherein the initializing defrost state comprises:

running the heat pump system in the defrost mode to transfer heat from an enclosed space to the evaporator coil located outside of the enclosed space to melt frost that has formed on the evaporator coil; and adding time to the defrost failsafe time.

14. The defrost method of claim 11, wherein the defrost state comprises:

running the heat pump system in the defrost mode to transfer heat from an enclosed space to the evaporator coil located outside of the enclosed space to melt frost that has formed on the evaporator coil.

15. The defrost method of claim 11, comprising:

responsive to a determination that that ratio is greater than a first threshold value, decreasing the defrost failsafe time to run the defrost state more frequently.

16. The defrost method of claim 11, wherein the calibration state comprises:

running the heat pump system in the defrost mode to transfer heat from an enclosed space to the evaporator coil located outside of the enclosed space to melt frost that has formed on the evaporator coil; and setting a value for the defrost failsafe time.

17. The defrost method of claim 16, wherein the calibration state comprises setting a value of a defrost flag to true.

18. The defrost method of claim 11, comprising:

determining if the amount of time is greater than a maximum defrost time; and responsive to a determination that the amount of time is greater than the maximum defrost time, shortening the defrost failsafe time to run the defrost state more frequently.

19. The defrost method of claim 18, wherein, responsive to a determination that the amount of time is less than the maximum defrost time, lengthening the defrost failsafe time to run the defrost state less frequently.

20. A heat pump system comprising:

an evaporator coil;

a condenser coil coupled to the evaporator coil to permit a fluid to cycle between the evaporator coil and the condenser coil;

a compressor coupled between the evaporator coil and the condenser coil;

a reversing valve configured to reverse a direction of flow of the fluid through the heat pump system; and a controller for initiating a defrost cycle of the heat pump system, the controller comprising a central processing unit and memory configured to:

run the heat pump system in a heating state a first time and determining if a calibration state has been previously run;

responsive to a determination that the calibration state has not been previously run, running the heat pump system in the calibration state;

run the heat pump system in the heating state a second time and determining if a difference in temperature between a clear coil temperature of the evaporator coil of the heat pump system and a current temperature of the evaporator coil is greater than a temperature threshold value;

responsive to a determination that the difference in temperature between the clear coil temperature and the current temperature is less than or equal to the threshold temperature value, run the heat pump system in an initializing defrost state;

responsive to a determination that the difference in temperature between the clear coil temperature and the current temperature is greater than the threshold temperature value, run the heat pump system in a defrost state;

monitor an amount of time that the heat pump system runs in a defrost mode;

determine a ratio of the amount of time to an initial defrost time; and responsive to a determination that the ratio is between a first threshold value and a second threshold value, add no time to a defrost failsafe time.

* * * * *